United States Patent [19]

Fischer et al.

[11] 4,015,164

[45] Mar. 29, 1977

[54] METALLIC HALIDE HIGH-PRESSURE GAS DISCHARGE LAMP

[75] Inventors: Ernst Fischer, Stolberg; Roland Lorenz; Ludwig Rehder, both of Aachen, all of Germany

[73] Assignee: U.S. Philips Corporation, New York, N.Y.

[22] Filed: Nov. 10, 1975

[21] Appl. No.: 630,536

[30] Foreign Application Priority Data

Nov. 30, 1974 Germany ..... 2456757

[52] U.S. Cl. ..... 313/223; 313/184

[51] Int. Cl.[2] ..... H01J 17/20

[58] Field of Search ..... 313/184, 223, 225, 229

[56] References Cited

UNITED STATES PATENTS

| | | | |
|---|---|---|---|
| 3,521,110 | 7/1970 | Johnson | 313/223 |
| 3,639,801 | 2/1972 | Jacobs | 313/223 |
| 3,764,843 | 10/1973 | Eijl | 313/184 |

*Primary Examiner*—R. V. Rolinec
*Assistant Examiner*—Michael J. Tokar
*Attorney, Agent, or Firm*—Frank R. Trifari; Robert S. Smith

[57] ABSTRACT

Metallic halide high-pressure gas discharge lamp whose filling contains elementary arsenic during operation.

9 Claims, 1 Drawing Figure

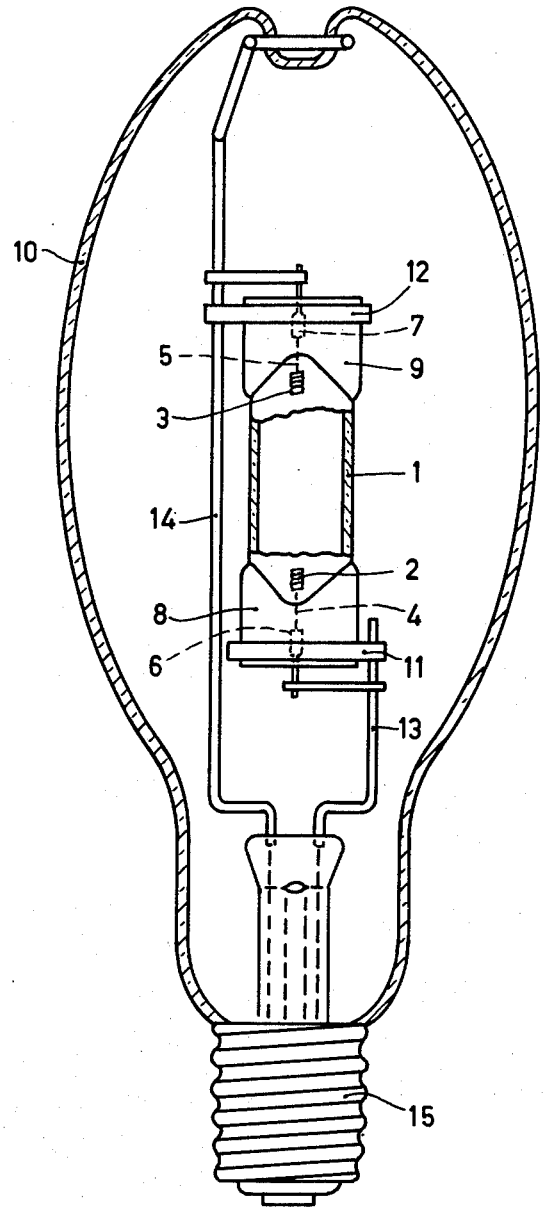
10
12
7
5
9
3
1
14
2
8
4
6
11
13
15

METALLIC HALIDE HIGH-PRESSURE GAS DISCHARGE LAMP

The invention relates to a metallic halide high-pressure gas discharge lamp having a hermetically closed, radiation-transmissive discharge vessel, two electrodes arranged therein between which the discharge takes place and a filling which contains at least one metallic halide and a buffer substance.

A lamp which has been used for a long time already and is used in great numbers is the high-pressure mercury vapour discharge lamp. A disadvantage of this lamp is that its colour rendition is less good and that it is therefore less suitable for general illumination for which a satisfactory colour rendition is necessary.

The addition of metallic halides, metallic iodides in particular, to the filling of high-pressure gas discharge lamps, especially high-pressure mercury vapour discharge lamps, results in many cases in a considerable improvement of the colour rendition and also of the radiation efficiency of the lamp (see U.S. Pat. No. 3,234,421). This Patent Specification describes, for example, a lamp which contains besides a rare gas and mercury the iodides of sodium, thallium and indium. During the operation of the lamp these metals emit their characteristic radiation, whilst the mercury spectrum is suppressed so that a lamp having a much better colour rendition is produced then is possible for lamps which contain mercury only. The spectrum of the emitted radiation of the iodide-containing lamps, is, however, mainly composed of spectral lines and therefore strongly differs from the continuous spectrum of a black body or of natural daylight. However, if very high demands are made on the colour rendition a continuous spectrum of the radiation emitted by the lamp is necessary.

From Dutch Patent Application No. 6,610,396 a high-pressure gas discharge lamp is known which contains tin bromide and / or tin iodide. This lamp emits the radiation originating from tin halide molecules. This molecular radiation has a continuous spectral distribution of such a form that an excellent colour rendition can be obtained. A high-pressure gas discharge lamp which emits a molecular radiation having a continuous spectrum is also known from German Patent Application DT-OS 2,023,770. This lamp contains tin chloride and furthermore tin, either in the form of metal or of tin iodide. It was found that the use of tin chloride yields in general higher radiation efficiencies than when tin bromide and tin iodide are used.

A disadvantage of these known, halide-containing lamps is that the presence of the halide may result in a serious chemical attack of the electrodes. In this respect especially the halides bromium and, to a still greater degree, chlorium must be considered as aggressive. The said chemical attack of the electrodes causes a migration of the electrode material, partly on the electrode itself, for another part from the electrode to the discharge vessel wall. A further corrosion of the electrode is caused by the load on the electrode during the ignition phase of the lamp (sputtering) and by evaporation of the electrode material due to the high temperature of the point of the electrodes where the arc terminates during operation of the lamp. Said corrosion processes may lead to a complete destruction of the electrodes and an impermissible blackening of the discharge vessel wall.

It is an object of the invention to provide a metallic halide high-pressure gas discharge lamp in which the occurrence of electrode corrosion and blackening of the wall is prevented or mitigated respectively.

For a metallic halide high-pressure gas discharge lamp of the above mentioned type according to the invention this is obtained due to the fact that the filling contains elementary arsenic during operation of the lamp.

A lamp according to the invention comprises a discharge vessel of, for example, quartz glass, densily sintered aluminium oxide or crystalline aluminium oxide (saphire). Placed in the discharge vessel are at least two electrodes which form a discharge path and which consist of a high-melting point metal, for example tungsten. As in the known lamps, the filling of the lamp contains at least one metallic halide and a buffer substance. The metallic halide and the buffer substance each take part in the discharge. The buffer substance evaporates during the operation of the lamp and the buffer gas then formed mainly determines the electric properties of the discharge, whilst it does not contribute or only in a very slight degree to the radiation emitted by the lamp. The use of a buffer gas leads to an increase of the operating voltage of the lamp and consequently enables an increase in the power input and an increase of the light output of the lamp. Known buffer substances in high pressure gas discharge lamps, are, for example, xenon, cadmium and in particular mercury. The spectral properties of the discharge are mainly determined by the metallic halide used.

According to the invention arsenic is added to the filling of a metallic halide high-pressure discharge lamp, which arsenic is vaporized during the operation of the lamp. It has been ascertained that the electrode corrosion and formation of a deposit on walls in lamps according to the invention is largely suppressed by this measure. Investigations which led to the invention have proved that the gaseous arsenic forms arsenic oxide together with the oxygen which is present in the lamp as a contamination. Consequently, the arsenic is capable of keeping the oxygen content in the lamp very low. As known the partial pressure of the oxygen in the lamp plays a decisive part with respect to the electrode corosion, i.e., to the transport reaction between the electrode material and the halides by the formation of, for example, tungsten oxide halide. With reference to the chemical action thereof, the arsenic in a lamp according to the invention may be called a volatile getter of oxygen. The use of such a gaseous getter has the advantage that the getter operation can be much more effective than when a solid getter is used.

Because the arsenic in a lamp according to the invention has a negligible effect on the spectral properties of the lamp and influences the electrical data in the same way as, for example, mercury the arsenic may also be referred to as buffer substance. Therefore it is perfectly possible that the function of buffer substance in the lamp is fully taken over by the arsenic.

Using arsenic in a lamp according to the invention has the added advantage that during operation of the lamp the quantity of the free halogens is strongly decreased by the formation of arsenic halides. Consequently the formation of oxide halides from the electrode material and therefore the electrode corrosion is further suppressed.

It is assumed that the reduction of the corrosion processes in a lamp according to the invention is also enhanced by the fact that during the operation of the lamp a layer of arsenides, for example, tungsten arsenide may form on the threatened areas of the electrode. The kinetics of the corrosive action on the electrodes is slowed down by such a layer.

Preference is given to lamps according to the invention which contain chloride and/or bromide as metallic halides, because these halides are particularly aggressive. The use of arsenic in chloride and/or bromide-containing lamps results in a reduction of the tungsten transport rate by a factor of, for example, 100 as compared with the same lamps without arsenic.

Although it is possible that the function of buffer substance in the lamp is completely performed by the arsenic, preference is given to lamps according to the invention which contain mercury as buffer substance. Greater light outputs are namely obtained with these lamps in which the arsenic is an extra addition to the mercury or only a partial replacement of the mercury.

A preferred embodiment of a lamp according to the invention contains a rare gas as starting gas, metallic chloride and, possibly, metallic iodide and/ or metallic bromide, and, possibly, an excess of metal and furthermore per $cm^3$ contents of the discharge vessel 0 – 25 mg of mercury and 0.1 – 10 mg of arsenic. The quantity of halide amounts to 1–30 $\mu$Mol. The ratio between the number of halogen and metal atoms is chosen between 0.1 and 2.5 and the ratio between the number of iodine and bromine atoms with respect to chlorine atoms between 0 and 4. With these lamps a particularly advantageous combination of high radiation output and a very good colour rendition can be obtained, whilst due to the reduction in the electrode corrosion the operating life of the lamps is considerably increased compared with the same lamps which contain no arsenic.

The best results with the lamp according to this preferred embodiment are obtained if the lamp contains for each $cm^3$ contents of the discharge vessel 1–5 of mercury, 0.2–3 mg of arsenic and 2–10 $\mu$mol of halide and if the ratio between the number of iodine- and bromine atoms with respect to chlorine atoms is chosen between 0 and 1. Preference is given to lamps according to the invention which contain tin halide as metallic halide. The continuous spectral distribution of the tin halide molecules namely is greatly desired and enables a very good colour rendition.

Herebelow the invention will be further described with reference to the drawing and to a number of examples and tests.

The FIGURE shows an embodiment of a metallic halide high-pressure gas discharge lamp according to the invention.

In the drawing reference 1 is the tubular quartz glass discharge vessel of a lamp according to the invention. The ends of vessel 1 comprise tungsten electrodes 2 and 3. The electrodes are supported by lead wires 4 and 5 which are fed vacuum-tight through the pinched parts 8 and 9 of the vessel 1 by means of molybdenum foils 6 and 7. The vessel 1 is suspended in a glass outer bulb 10 by means of metal strips 11 and 12, which are placed around the pinched parts 8 and 9 which are placed around pinched parts 8 and 9 and which are connected to supporting poles 13 and 14 which also serve as current supply elements for the electrodes 2 and 3. The current supply elements 13 and 14 are led out vacuum-tight through the outer bulb 10 and connected to contacts of a lamp socket 15. The inner diameter of the vessel 1 is approximately 15 mm and its contents approximately 11.5 $cm^3$. The distance between the electrodes 3 and 2 is approximately 40 mm. The lamp is destined for a load of 400 W. The lamp contains mercury, arsenic, and at least one metallic halide.

The embodiments below show the lamp dosing and the results of measurements at these lamps (at 400 W).

EXAMPLE 1

Dosing:
7 mg $SnCl_2$
29 mg Hg
20 mg As
25 Torr Ar

Measurements:
Light output 50 Lm/W
Colour temperature 6800 K
Operating voltage 174 V
Current strength 3.2 A The tungsten transport rate in comparison with the same lamp which, however, did not contain arsenic, appeared to be a factor 100 lower. This was determined by means of a chemical analysis.

EXAMPLE 2

Dosing: 10,5 mg $SnCl_2$
29 mg Hg
20 mg As
25 Torr Ar

Measurements: Light output 55 Lm/W
Colour temperature 6300K
Operating voltage 178V
Current strength 3.05A In comparison with the same lamp without arsenic the electrode corrosion and the wall blackening appeared to be a factor 150 lower. This was determined by measuring the decline in luminous efficiency during the operating life of the lamp. To this end a comparison was made between the operating periods of the lamps at 20% decline in luminous efficiency.

EXAMPLE 3

Dosing: 7 mg $SnCl_2$
7 mg $SnJ_2$
29 mg Hg
7 mg As
25 Torr Ar

Measurements: Light output 59Lm/W
Colour temperature 6300K
Operating voltage 155V
Current strength 3.6A The electrode corrosion and wall blackening, compared with the same lamp without arsenic was reduced by a factor 100. (determined by measuring the decline in the luminous efficiency).

EXAMPLE 4

Dosing: 8,4 mg $SnBr_2$
25 mg Hg
20 mg As
25 Torr Ar

Measurements:
Light output 50 Lm/W
Colour temperature 5500K
Operating voltage 152V
Current strength 3.5A The electrode corrosion and wall blackening compared with the same lamp without arsenic was reduced by a factor 50. (Determined by measuring the decline in luminous efficiency).

EXAMPLE 5

Dosing: 4 mg Sb
22.8 mg $Hg_2Cl_2$
5.6 mg Hg
20 mg As
25 Torr Ar
Measurements: Light Output 47 Lm/W
Colour temperature 7000K
Operating voltage 160V
Current strength 3.6A Electrode corrosion and wall blackening, compared with the same lamp without arsenic was reduced by a factor 90 (determined by measuring the decline in luminous efficiency).

EXAMPLE 6

Dosing: 6.8 mg Bi
22.8 mg $Hg_2Cl_2$
5.6 mg Hg
20 mg As
25 Torr Ar
Measurements: Light output 45 Lm/W
Colour temperature 6300K
Operating voltage 160V
Current strength 3.5 A Electrode corrosion and wall blackening, compared with the same lamp without arsenic was reduced by a factor 80. (determined by measuring the decline in luminous efficiency).

What is claimed is:

1. A metallic halide high-pressure gas discharge lamp having a hermetically closed, radiation transmissive discharge vessel, having two electrodes arranged therein between which the discharge takes place and a filling comprising at least one metallic halide and a buffer substance, and during operation of the lamp the filling contains elementary arsenic.

2. A lamp as claimed in claim 1, wherein said metallic halide contains chloride.

3. A lamp as claimed in claim 1 wherein the buffer substance contains mercury.

4. A lamp as claimed in claim 1 wherein said filling includes a rare gas as a starting gas, said metallic halide contains chloride, and that per $cm^3$ contents of the discharge vessel there is 0–25 mg of mercury, 0.1–10mg of arsenic and 1–30$\mu$mol of halide and that the ratio between the member of halogen- and metal atoms is between 0.1 and 2.5 and the ratio between the number of bromine and iodine atoms with respect to chlorine atoms is between 0 and 4.

5. A lamp as claimed in claim 4, characterized in that the discharge vessel contains per $cm^3$ content 1–5 mg of mercury, 0.2–13 mg of arsenic and 2–10 $\mu$mol of halide and that the ratio between the number of bromine- and iodine atoms with respect to chlorine atoms is between 0 and 1.

6. A lamp as claimed in claim 1 wherein the metallic halide is tin halide.

7. A lamp as claimed in claim 1 wherein said metallic halide contains bromide.

8. A lamp as described in claim 4 wherein said filling further includes metallic bromide.

9. A lamp as described in claim 4 wherein said lamp contains an excess of metal.

* * * * *

UNITED STATES PATENT AND TRADEMARK OFFICE

CERTIFICATE OF CORRECTION

PATENT NO. : 4015164

DATED : March 29, 1977

INVENTOR(S) : ERNST FISCHER ET AL

It is certified that error appears in the above-identified patent and that said Letters Patent are hereby corrected as shown below:

Column 6, Claim 5, line 3, "0.2-13" should be --0.2-3--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*